US005471904A

United States Patent [19]

Armstrong

[11] Patent Number: 5,471,904

[45] Date of Patent: Dec. 5, 1995

[54] AMMUNITION FEEDER CHUTE

[75] Inventor: Gregory C. Armstrong, Transvaal, South Africa

[73] Assignee: Denel (Proprietary) Limited, Pretoria, South Africa

[21] Appl. No.: 81,108

[22] Filed: Jun. 25, 1993

[30] Foreign Application Priority Data

Jun. 26, 1992 [ZA] South Africa ..... 92/4763

[51] Int. Cl.[6] ..... F41A 9/57

[52] U.S. Cl. ..... 89/33.14; 193/25 AC

[58] Field of Search ..... 89/33.01, 33.14; 193/25 AC

[56] References Cited

U.S. PATENT DOCUMENTS

| | | | |
|---|---|---|---|
| 2,303,976 | 12/1942 | Bawcutt et al. . | |
| 2,310,884 | 2/1943 | Trevaskis . | |
| 2,351,370 | 6/1944 | Schaaff . | |
| 2,449,849 | 9/1948 | Holmes | 193/25 AC |
| 2,510,191 | 6/1950 | Nobles . | |
| 2,819,780 | 1/1958 | Fallon et al. . | |
| 2,866,531 | 12/1958 | Nobles . | |
| 2,890,779 | 6/1959 | Aumann . | |
| 3,250,360 | 5/1966 | Correll . | |
| 3,307,452 | 3/1967 | Meunier . | |
| 3,435,937 | 4/1969 | Tassle . | |
| 4,338,851 | 7/1982 | Bremer et al. | 89/33.14 |
| 4,976,185 | 12/1990 | Wixon et al. . | |

FOREIGN PATENT DOCUMENTS

| | | | |
|---|---|---|---|
| 673335 | 2/1990 | Switzerland . | |
| 590783 | 7/1947 | United Kingdom | 89/33.01 |
| 624358 | 6/1949 | United Kingdom . | |
| 1427576 | 3/1976 | United Kingdom . | |
| 2031129 | 4/1980 | United Kingdom . | |

*Primary Examiner*—Stephen C. Bentley

*Attorney, Agent, or Firm*—Oblon, Spivak, McClelland, Maier, & Neustadt

[57] ABSTRACT

An ammunition feeder chute includes a plurality of unitary segments injection molded from a flexible thermoplastics material. The segments are articulated to one another in side-by-side relationship, and are interconnected by a cable which passes through a pair of apertures formed in opposed side walls of each segment. The opposed side walls are joined by an elongate base member which has a predetermined torsional flexure for facilitating overall torsional flexure of the feeder chute. Each segment is formed with complemental arcuate tab and recess formations for allowing pivoting of adjacent segments relative to one another.

5 Claims, 12 Drawing Sheets

FIG. 1
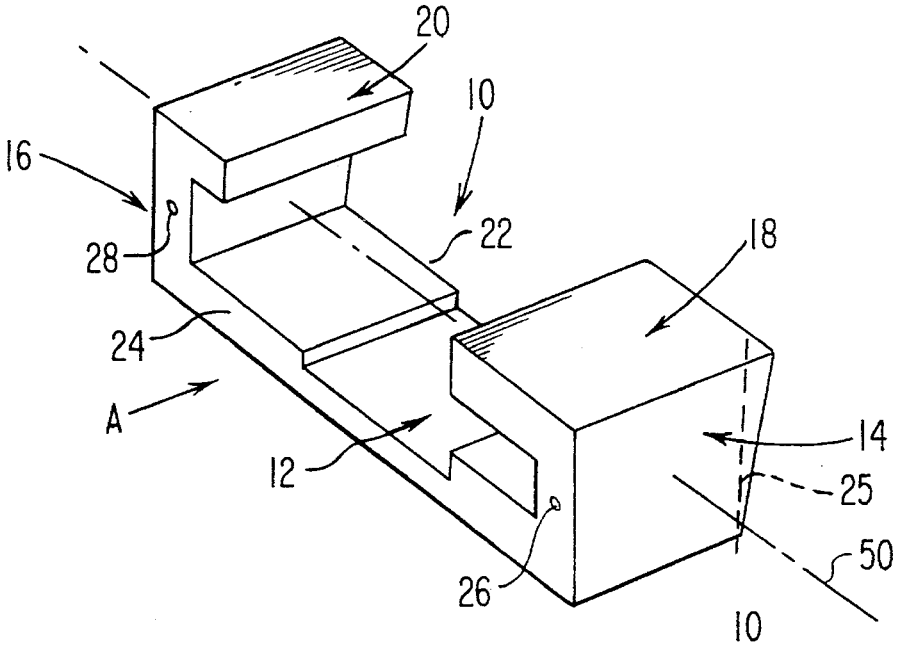
FIG. 2
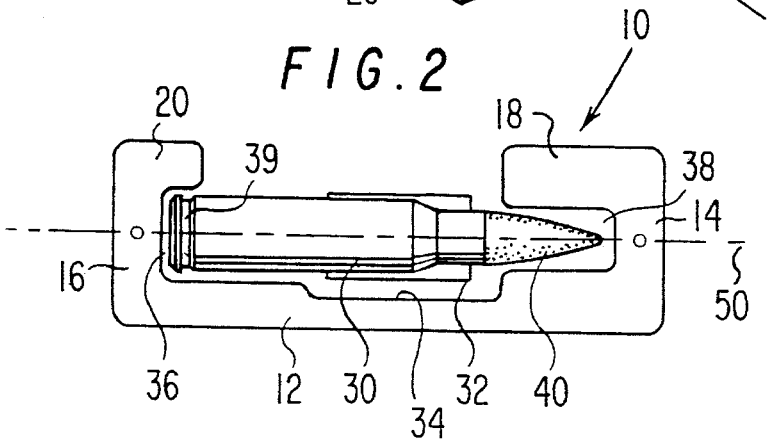
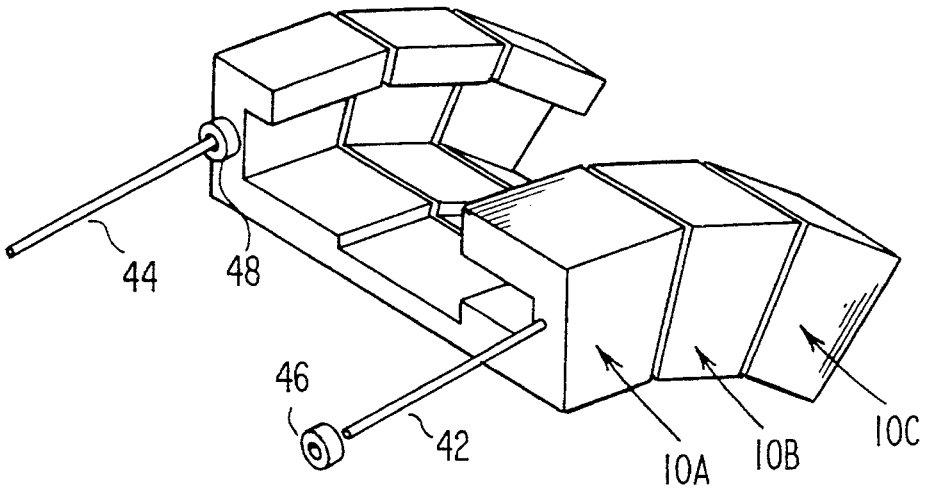
FIG. 3

FIG.4
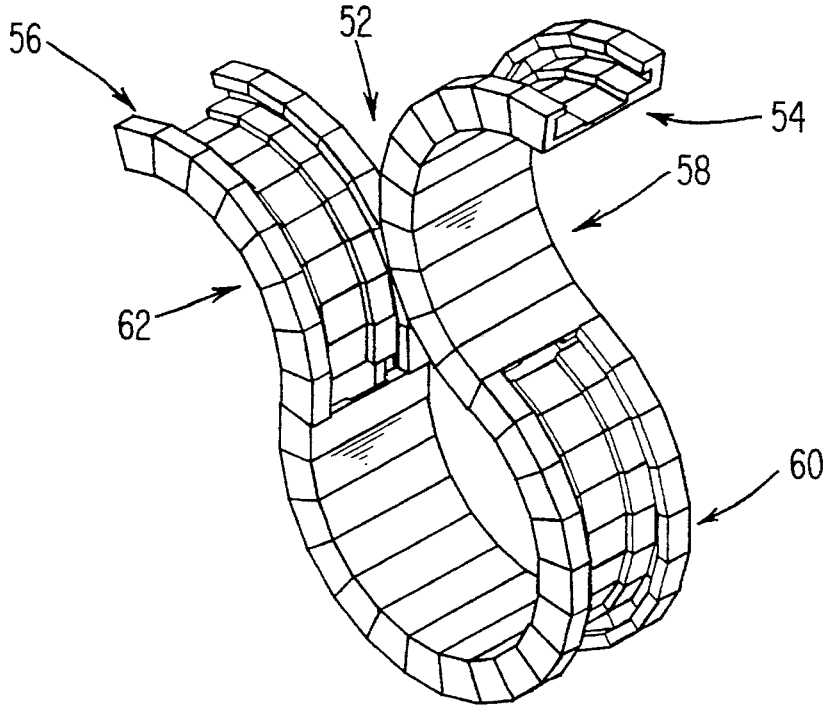
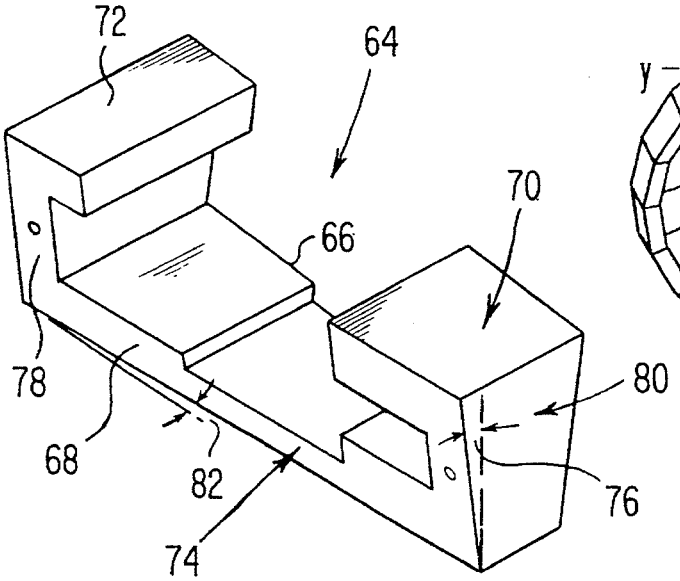
FIG.5
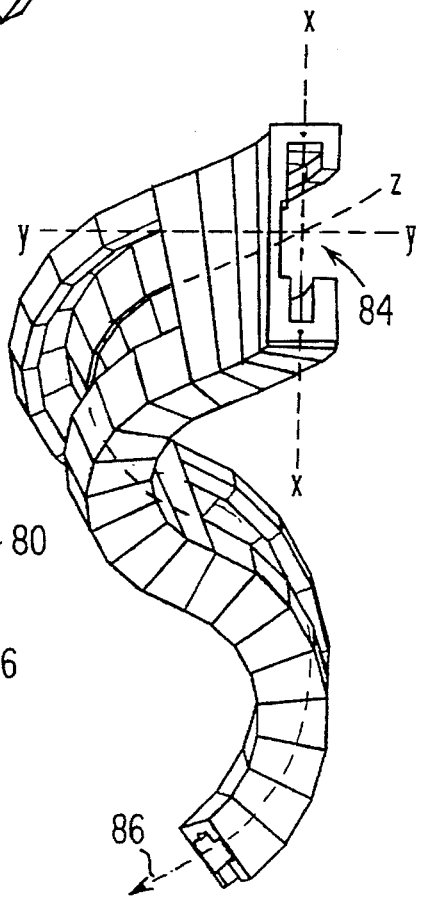
FIG.6

FIG. 15
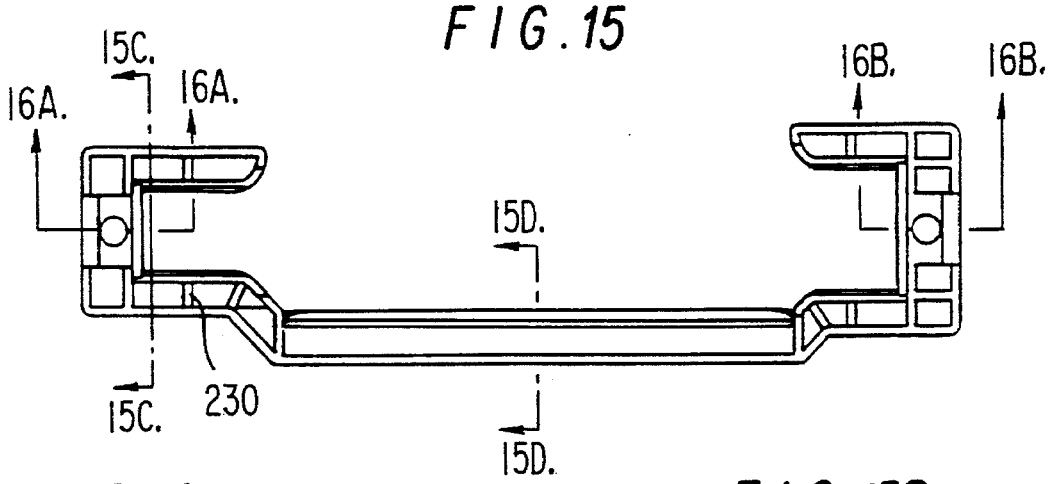
FIG. 15A
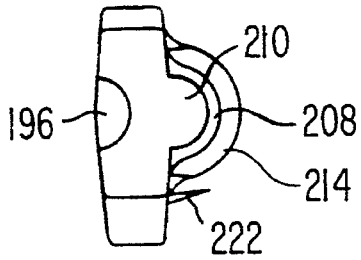
FIG. 15B
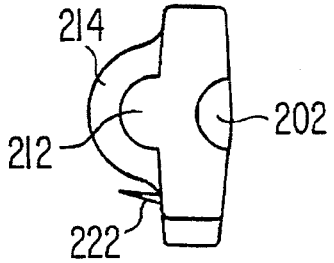
FIG. 15C
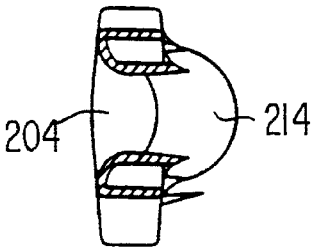
FIG. 15D
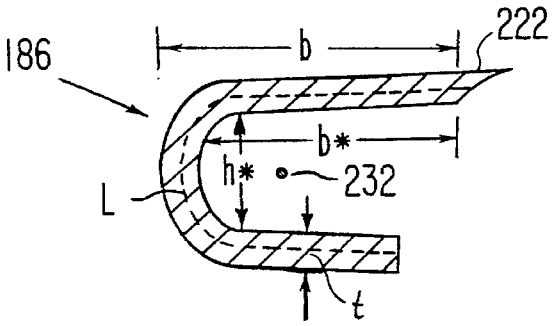
FIG. 16A
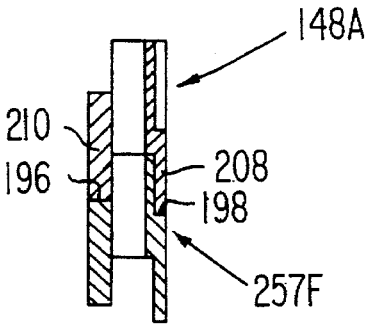
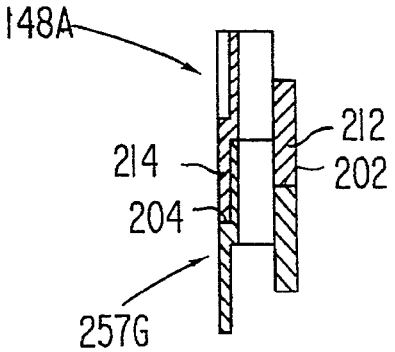
FIG. 16B

AMMUNITION FEEDER CHUTE

BACKGROUND TO THE INVENTION

1. Field of the Invention

Ammunition feeder chutes are used to provide support to an ammunition belt as it moves from the ammunition box in which it is housed to the feed slide of a machine gun. A primary requirement of a feeder chute is that it should be able to function at any angle and position of the weapon without snagging whilst the machine gun turret is in motion.

2. Discussion of the Background

Conventional feeder chutes comprise segments formed from a metal such as steel which are articulated to one another by means of separate connections formed between the segments. It has been found that the flexure of a belt of this type along the longitudinal axis of the belt is limited. One type of conventional feeder belt allows for twisting of the belt about its longitudinal axis by providing rigid metal segments with relatively complex multi-component pivoting mechanisms. Metal belts of this type are susceptible to corrosion, metal fatigue and permanent deformation by way of buckling and bending.

SUMMARY OF THE INVENTION

According to a first aspect of the invention there is provided an ammunition feeder chute comprising a plurality of elongate segments disposed transversely relative to a longitudinal axis of flexure of the chute, at least two apertures extending through each segment, at least one flexible cable passing through the respective apertures for interconnecting the segments in articulated, side-by-side relationship, and a plurality of spacer elements for spacing the segments apart and being arranged to allow pivoting of adjacent segments relative to one another, thereby to facilitate flexure of the feeder chute along the longitudinal axis.

Preferably, each segment is unitary, and is arranged to have a predetermined torsional flexure about a major axis thereof, thereby to allow corresponding overall torsional flexure of the chute about the longitudinal axis.

Conveniently, the spacer elements comprise complemental arcuate tab and recess formations formed integrally with and of the same material as each segment.

Advantageously, the arcuate tab and recess formations comprise, on each segment, an outer pair of tabs and a corresponding outer pair of recesses disposed rearwardly of the outer pair of tabs, an inner pair of tabs and a corresponding inner pair of recesses disposed rearwardly of the inner pair of tabs, the apertures extending parallel to and between the inner and outer tabs.

Typically, the inner pairs of tabs and corresponding inner pairs of recesses in combination define a corresponding pair of opposed continuous inner side wall surfaces.

Each segment is preferably C-shaped in profile, having an elongate base member and a pair of side walls projecting from opposite ends of the base member and terminating in re-entrant portions extending towards one another, thereby to define a complemental channel for an ammunition belt.

Conveniently, each segment has a leading face and an opposed trailing face, the leading face of each segment defining an arcuate concave surface and the trailing face of each segment defining an arcuate convex surface, whereby the leading face of one segment is arranged to slide over the trailing face of an adjacent segment in an overlapping relationship, thereby to provide a continuous land for an ammunition belt.

Advantageously, each segment is substantially C-shaped in transverse cross section, for facilitating torsional flexure of each segment, and for enhancing sliding articulation of adjacent segments over one another.

In a preferred form of the invention, the ammunition feeder chute includes front and rear cable fastening segments carrying coupling means for detachably fastening respective opposite ends of the chute to the feed slide of a machine gun and to an ammunition belt receptacle, at least one of the fastening segments including anchoring formations for anchoring opposite ends of the cable.

Stop means, such as a plurality of inserts which are removably locatable within pockets defined within each segment, are conveniently provided for selectively limiting pivoting movement of adjacent segments, thereby to control overall flexure of the feeder chute in predetermined zones.

The invention extends to a unitary segment for an ammunition feeder chute comprising an elongate base member, a pair of side walls projecting from opposite ends of the base member and terminating in reentrant portions extending towards one another, thereby to define a complemental channel for an ammunition belt, and an aperture extending through each side wall for receiving a flexible cable for interconnecting the segment to adjacent segments in an articulated side- by-side relationship, the elongate base member having a predetermined torsional flexure for facilitating corresponding torsional flexure of the feeder chute.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1 shows a perspective view of a first basic embodiment of a segment forming part of an ammunition feeder chute of the invention;

FIG. 2 shows a side view of the segment of FIG. 1 with a live round forming part of a belt of ammunition mounted in position within the segment;

FIG. 3 shows an exploded perspective view of a portion of an ammunition feeder chute formed from segments of FIG. 1;

FIG. 4 shows an ammunition feeder chute assembled from the segments of FIG. 1;

FIG. 5 shows a perspective view of a segment which forms part of a second basic embodiment of an ammunition feeder chute of the invention;

FIG. 6 shows a perspective view of the second embodiment of the ammunition feeder chute of the invention formed from the segments of FIG. 5.

FIG. 15 shows a front view of a segment of FIG. 13;

FIGS. 15A and 15B show left and right side views of the segment of FIG. 15;

FIGS. 15C and 15D show respective cross-sectional and enlarged cross-sectional views on the lines 15C—15C and 15D—15D of FIG. 15;

FIGS. 16A and 16B show a cross-sectional view respectively taken along lines 16A—16A and 16B—16B;

DESCRIPTION OF THE PREFERRED EMBODIMENTS

Figure 7:
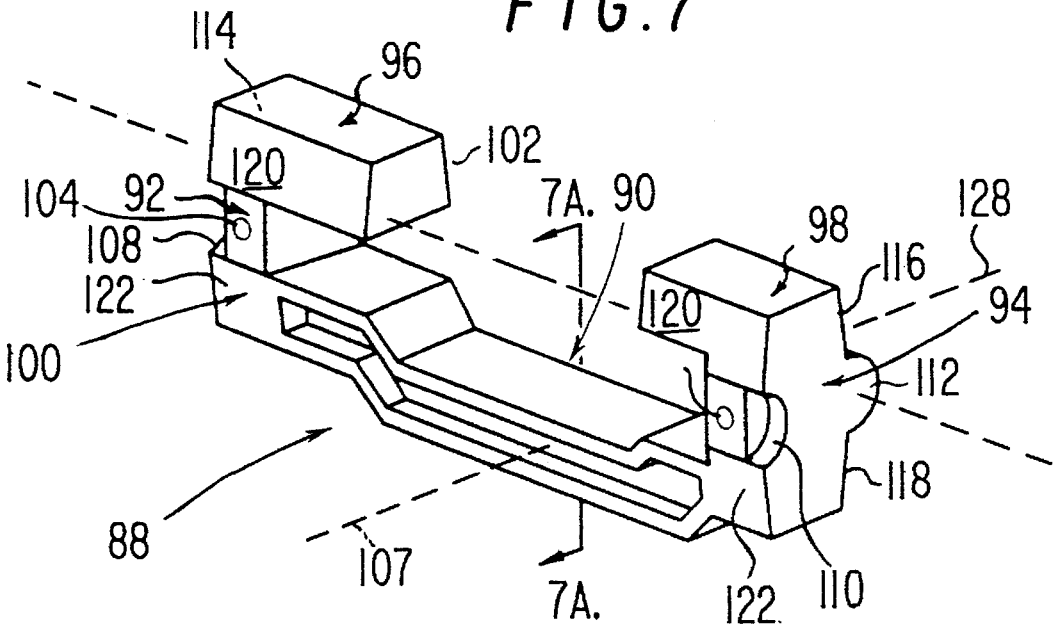
FIG. 7 shows a perspective view of a third more refined embodiment of a middle segment forming part of an ammunition feeder chute of the invention.

Referring to FIG. 1, a segment 10 forming part of an ammunition feeder chute is injection molded from a polymeric plastics material such as polyurethane or nylon. The segment is substantially C-shaped in profile, having a base 12, side walls 14 and 16 extending upwardly from opposite ends of the base 12, and re-entrant portions 18 and 20 extending inwardly from the ends of the respective side walls 14 and 16 in the direction parallel to the base 12. The segment 10 has a front planar face 22 and a rear planar face 24 which taper inwardly at an angle of approximately 7½° per face towards one another from the re-entrant portions 18 and 20 to the base 12, as is shown at 25. Holes 26 and 28 are formed in the respective side walls 14 and 16, the holes extending from the front face 22 to the rear face 24 of the segment.

Referring now to FIG. 2, it can clearly be seen that the segment 10 is shaped to accommodate a round of 7.62 mm ammunition 30. The round of ammunition forms part of an ammunition belt which is held together by means of clips 32. The base 12 has a trough 34 for accommodating the clips 32. The re-entrant portion 20, the side wall 16 and the base 12 in combination define a bight portion 36 for loosely retaining the cartridge end 39 of the round 30. Likewise, the re-entrant portion 18, the side wall 14 and the base 12 define a further bight portion 38 for loosely accommodating the sharp end 40 of the round 30.

As can be seen in FIG. 3, individual segments 10A, 10B and 10C are strung together on a pair of steel cables 42 and 44 which are fed through the respective holes 26 and 28. Interposed between the segments are flexible washers 46 and 48 which are formed from a resilient rubber-like material such as neoprene. The washers 46 and 48 space the segments evenly from one another and permit flexure of the segments relative to one another about an axis parallel to the longitudinal axis of symmetry 50 of the rounds of ammunition 30. Each segment has predetermined torsional flexure about an axis parallel to the axis of symmetry 50, which facilitates torsional flexure of the entire chute about an axis which is normal to the axis of symmetry 50, and which is parallel to the line defined by the direction of movement of the ammunition belt.

The assembled ammunition feeder chute 52 as is shown in FIG. 4 is formed from a plurality of segments identical to those illustrated in FIGS. 1, 2, and 3. The ammunition feeder chute 52 has one end 54 which is mounted to an ammunition box which houses a continuous ammunition belt and an opposite end 56 which is mounted by means of a suitable adapter to a machine gun feed slide. A first group 58 of segments adjacent the end 54 is strung together with their bases 12 facing downwards, so as to adopt a convex shape. A second intermediate group 60 of segments is strung together with their bases 12 inverted so as to achieve an overall concave shape. The final group 62 of segments is again strung together with their bases facing downwards so as to assume, in combination, a concave shape. The ammunition feeder chute may be extended by means of further alternating groups of segments so as to achieve an overall serpentine effect, which facilitates flexure of the chute about the longitudinal axis of the individual rounds making up the ammunition belt. The ammunition feeder chute illustrated in FIG. 4 is designed for use where the variation in relative position between the ammunition box and the machine gun is generally confined to a plane normal to the axis of symmetry 50.

Referring now to FIG. 5, a second embodiment of a segment 64 is shown which incorporates a double taper. The front and rear faces 66 and 68 thereof taper inwardly from the re-entrant portions 70 and 72 to the base 74 at an angle of approximately 7½° , as is shown at 76. Furthermore, the front and rear faces 66 and 68 taper inwardly from the side wall 78 to the side wall 80 at an angle of 3° , as is shown at 82. When these individual segments 74 are strung together in the arrangement illustrated in FIG. 6, a complete feeder chute 84 is formed having a complex three-dimensional curve. With a feeder belt of this type, points (representing the respective positions of the ammunition box and the machine gun) having different x,y and z coordinates can be joined, the x-axis being in parallel to the axis of symmetry of the rounds. In this application, the ammunition box may thus be mounted at any vertical angle relative to the machine gun.

The flexibility of the ammunition feeder chutes is achieved both by the interposed resilient washers 46 and 48, and by the natural flexibility of the segments themselves. As individual segments are formed from a polymeric material having a shore hardness of between 50 and 70*d*, and preferably 60*d*, they are able to flex about an axis parallel to the longitudinal axis of symmetry 50 of the individual rounds. This allows the chute to rotate about an axis parallel to the direction of feed 86 of the ammunition at any point within the chute.

Referring now to FIG. 7, a third more refined embodiment of a segment 88 is illustrated. The segment is substantially C-shaped in profile, having a base 90, side walls 92 and 94 extending upwardly from opposite ends of the base and re-entrant portions 96 and 98 extending inwardly from the ends of the respective side walls 92 and 94. The segment 88 has a rear or trailing face 100 and a front or leading face 102. A pair of apertures 104 and 106 extend parallel to the longitudinal axis of flexure 107 of the chute, and are positioned mid-way along the side walls 92 and 94.

A pair of semi-circular indents 108 and 110 are provided alongside the apertures 104 and 106, and extend inwardly from the rear face 100. A pair of complemental semi-circular tabs 112, only one of which can be seen in FIG. 7, protrude from the front face 102 of the segment alongside the apertures 104 and 106 and co-planar with the side faces 114 of the segment. The front face has respective upper and lower surfaces 116 and 118 which taper inwardly towards the respective reentrant portions 96 and 98 and the base 90. The rear face has similar inwardly tapering surfaces 120 and 122.

Figure 8:
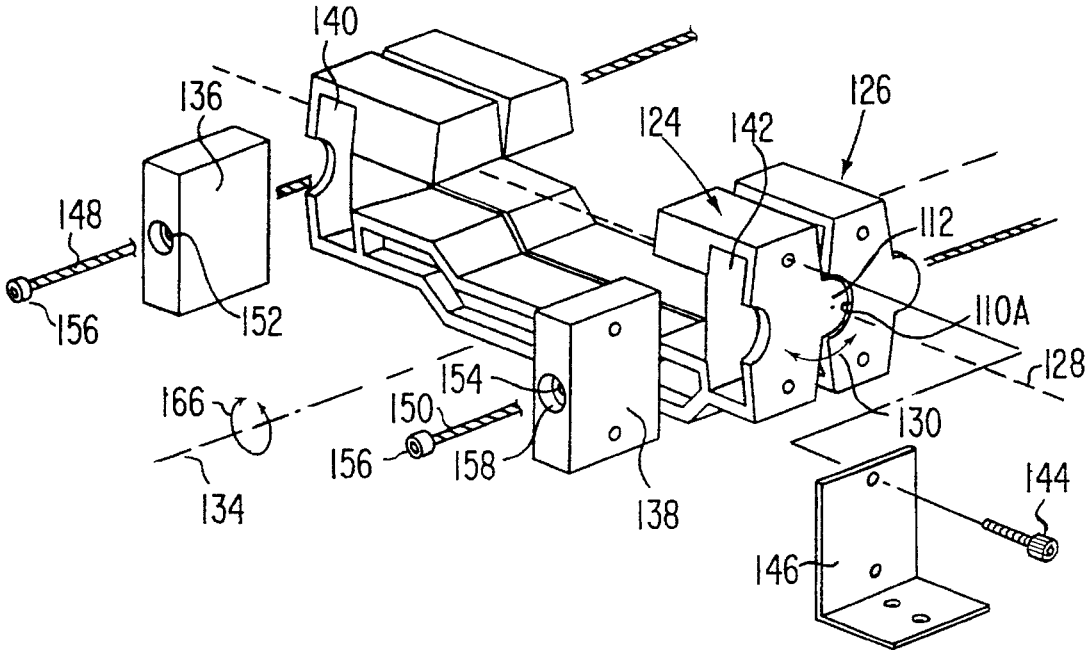
FIG. 8 shows a perspective exploded view of an end segment and anchoring means for coupling the end segment with the middle segment illustrated in FIG. 7.
Figure 11:
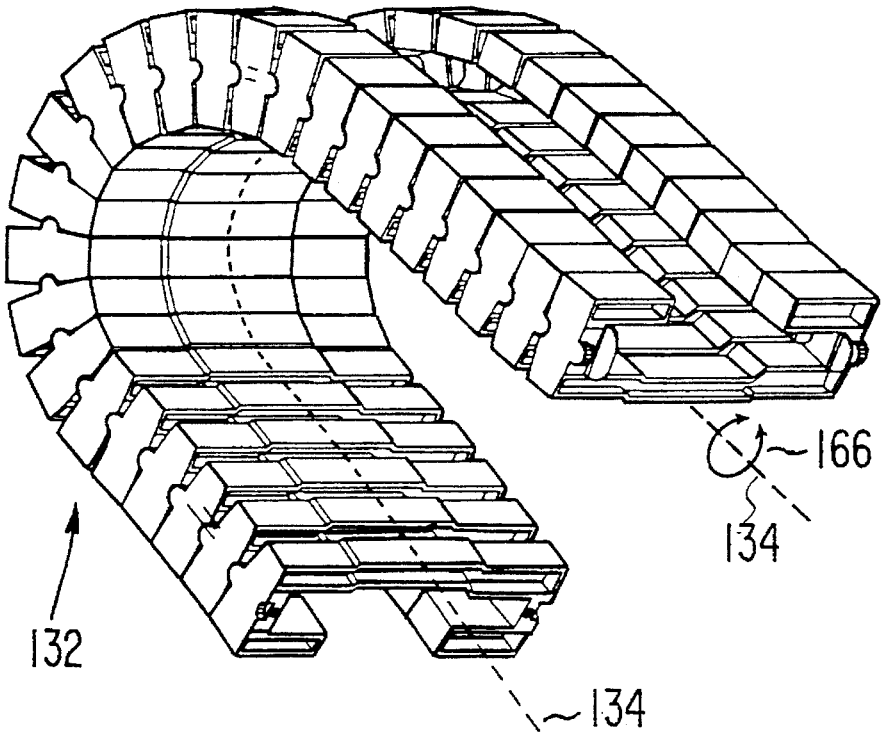
FIG. 11 shows a perspective view of part of an ammunition chute formed out of the segments illustrated in FIGS. 9 and 10.

As is clear from FIG. 8, in which an end segment 124 is shown articulated to an adjacent middle segment 126, the semi-circular tabs 112 of the end segment nest pivotally within a complemental pair of indents 110A formed in the rear face of the segment 126. The semicircular tab 112 and its complemental recess 110A allow the adjacent segments 124 and 126 to pivot relative to one another about a transverse axis 128, as is shown by arrows 130. The tabs 112 and complemental recesses 110A therefore perform the dual role of spacing the segments from one another and allowing the segments to pivot smoothly relative to one another about the axis 128. As can be seen in FIG. 11, which illustrates part of an assembled ammunition feeder chute 132, the semicircular tab and indent arrangement facilitates flexure of the chute in line with its longitudinal axis of flexure 134. The degree of tapering of the upper and lower front faces 116 and 118 and the rear faces 120 and 122 determines the extent of flexure.

A pair of stop blocks 136 and 138 nest within the complemental cavities 140 and 142 formed in the side walls 92 and 94. The stop blocks are clamped in position by means of coach screws 144 which serve both to anchor mounting brackets 146 to the end segment 124 and to lock the stop blocks 136 and 138 firmly within the end segment 124.

A flexible pair of steel cables 148 and 150 are passed through the apertures 152 and 154 formed in the respective stop blocks 136 and 138. The end segment 124 and subsequent middle segments 126 are subsequently threaded onto the cables 148 and 150, with the cables 148 and 150 passing through the respective apertures 104 and 106 in the segments. Cylindrical stops 156 are mounted on the ends of the cables 148 and 152, and nest in complemental cavities 158 formed in the stop blocks 136 and 138. The cylindrical stops 156 and complemental cavities serve to anchor the cables 148 and 150 firmly within stop blocks 136 and 138.

Figure 7A:
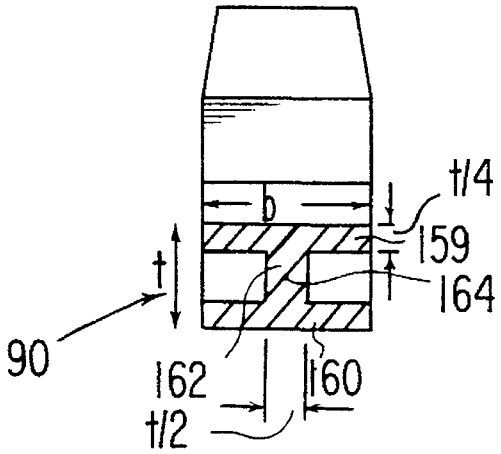
FIG. 7A shows a cross-section on the line 7A—7A of FIG. 7.

Turning now to FIG. 7A, it is clear that the base 90 has an H-shaped profile, with upper and lower beams 159 and 160 joined by a central web 162. Relative to a solid beam having the same height and width, the torsional stiffness of the H-shaped base 90 is considerably reduced while the bending stiffness remains relatively constant. The base 90 has a width b and a height t, with the respective thicknesses of the upper and lower beams 159 and 160 being t/4 and the width of the web 162 being t/2. A rough calculation shows that the bending stiffness of a solid rectangular section having width b and height t is proportional to $bt^3$, while the bending stiffness of the H-shaped section of FIG. 7A is approximately proportional to $\frac{7}{8}bt^3$, resulting in a negligible reduction of bending stiffness of approximately 12.5%. The torsional stiffness of the solid rectangular section is proportional to $bt^3$, while that of the H-shaped section is proportional to $bt^3/32$, which represents a substantial reduction in torsional stiffness of 96%. It must be appreciated that the above formulas are only approximations which find particular application when b is appreciably greater than t.

As a result of the increased torsional flexure about the major axis 164, the flexibility of the ammunition feeder chute about the axis of flexure 134 in the direction of arrows 166, which lie in a plane normal to the axis 134, is considerably increased. This is achieved using a unitary structure without any additional pivoting components.

Figure 9A:
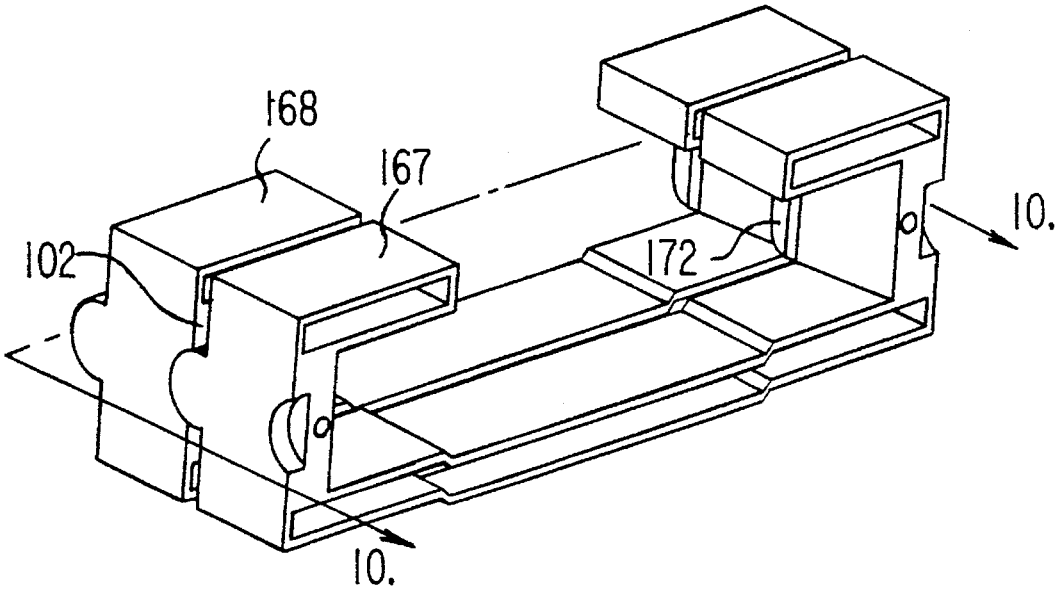
FIG. 9A shows a rear perspective view of a pair of segments articulated together, the segments being similar to the segment illustrated in FIG. 7.
Figure 9B:
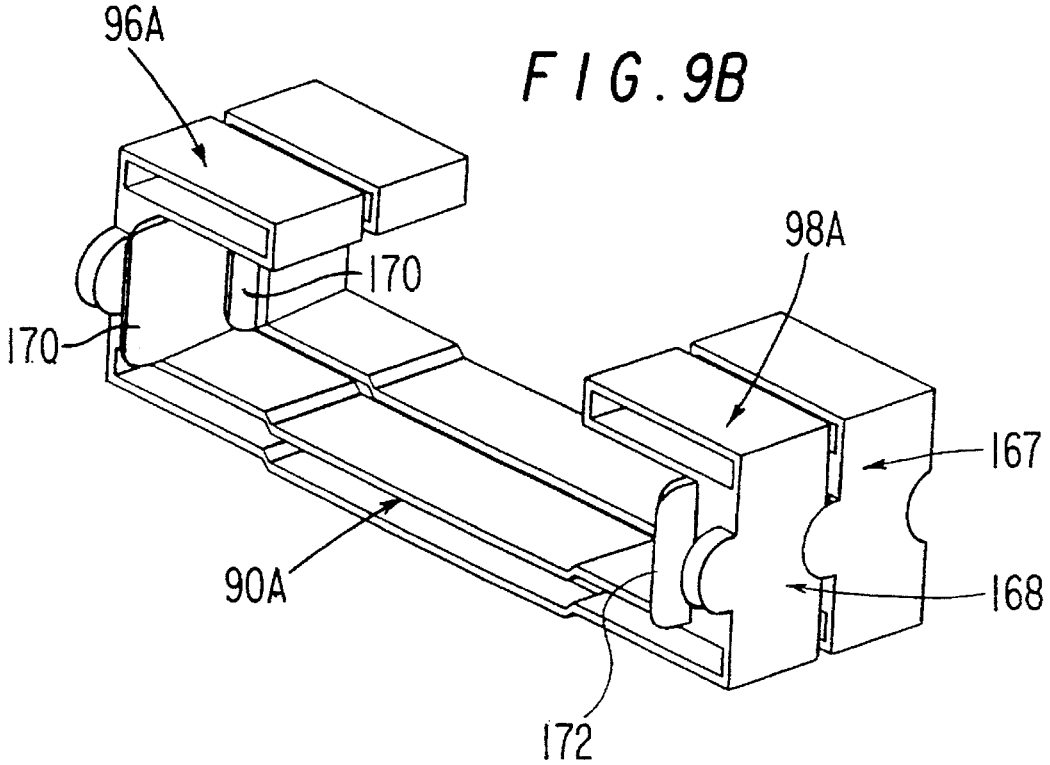
FIG. 9B shows a front perspective view of the pair of segments illustrated in FIG. 9A.
Figure 10:
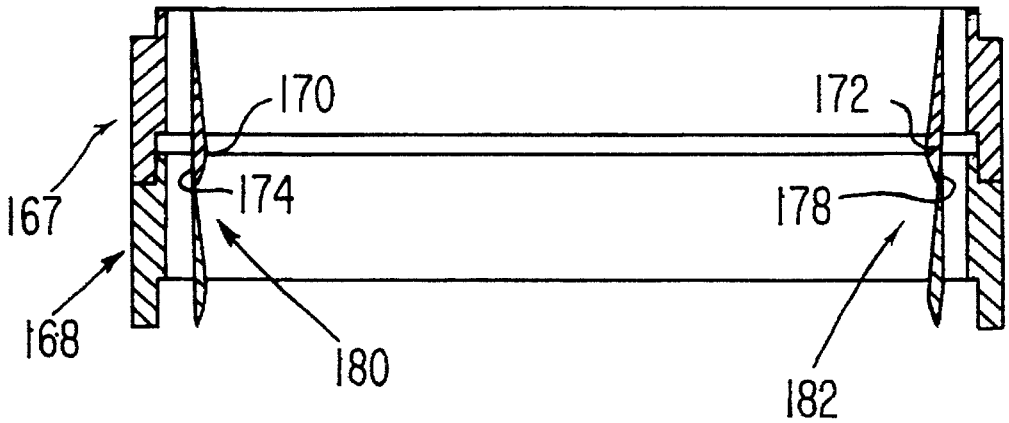
FIG. 10 shows a cross-section taken along line 10—10 of FIG. 9A.

Turning now to FIGS. 9A to 10, it can clearly be seen how each segment 167 and 168 has pair of flaps 170 and 172 which extend forwardly from the front surface of each segment 167 and 168. The flaps 170 and 172 close the gaps between the segments, by extending over the respective tail portions 174 and 176 of the adjacent segment 168. As a result, the inner side surfaces 180 and 182 of the ammunition feeder chute are relatively smooth, and reduce the tendency of the belt to snag as it travels through the chute.

The H-shaped hollowed out profile of both the base 90A and the re-entrant portions 96A and 98A contribute to a reduction both in material used and in torsional stiffness.

The use of a polymeric plastics material also achieves a relatively low co-efficient of friction between the ammunition belt and the feed chute. The surface finish of the individual segments may be chosen so as to achieve a low microscopic co-efficient of friction.

The individual segments are injection moulded, and various inserts in the molds may facilitate tapering of the segments in whatever direction is required so as to make up the final overall shape of the feeder chute. Inversion and reversal of various groups of segments make it possible to achieve relatively complicated geometries by using only a few basic shapes. Variation in overall flexibility of the belt may be achieved by varying the overall tension in the cables 42, 44 and 148, 150, which have their ends anchored to opposite end segments of the belt. Flexibility of the belt may also be adjusted by altering the shore hardness of the polymeric material used to manufacture the individual segments.

Figure 12:
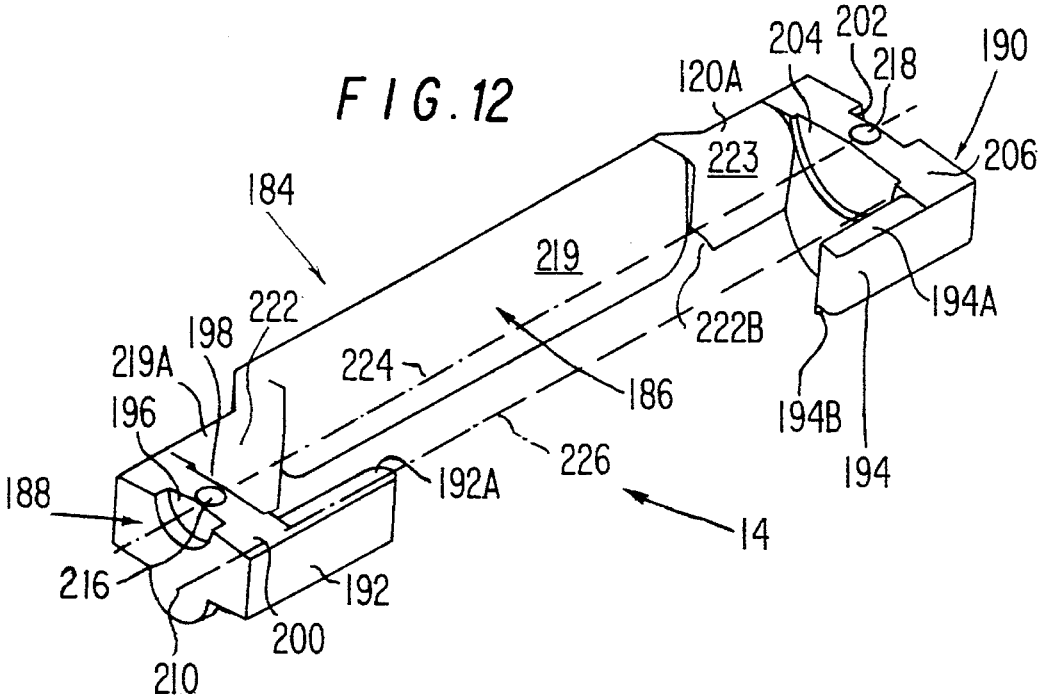
FIG. 12 shows a rear perspective view of a segment forming part of a further preferred embodiment of an ammunition feeder chute of the invention.

Referring now to FIG. 12, a rear perspective view of a further preferred embodiment 184 of a segment is shown. The segment is also substantially C-shaped in profile, having a base 186 and side walls 188 and 190 having respective re-entrant portions 192 and 194 extending inwardly therefrom. The side wall 188 is formed with an outer semicircular indent 196 and an inner semi-circular indent 198, both of which extend inwardly from a rear face 200 of the side wall 190. The side wall 190 is similarly formed with outer and inner semi-circular indents 202 and 204 which extend inwardly from its rear or trailing face 206.

Figure 13:
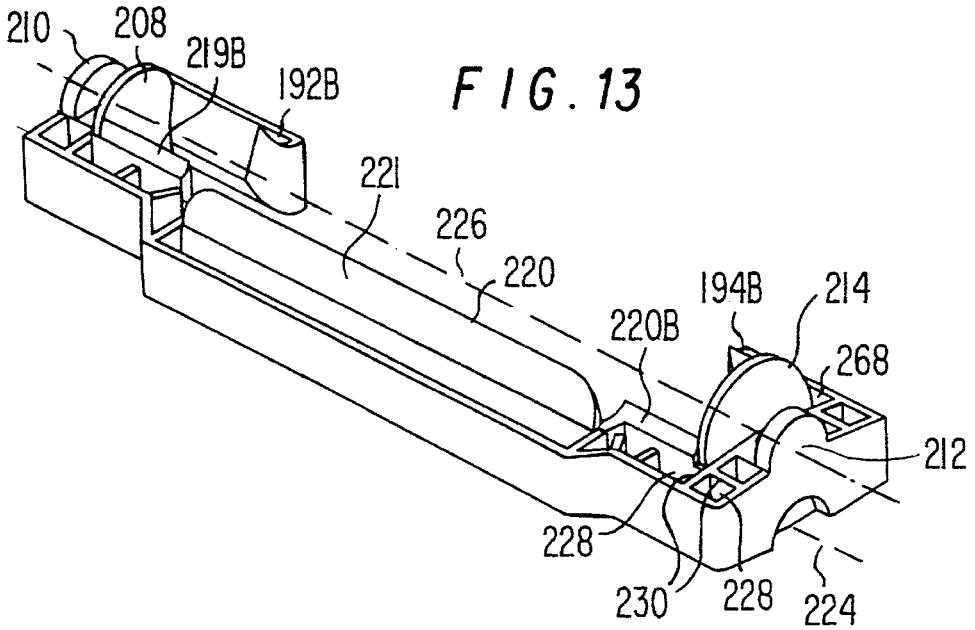
FIG. 13 shows a front perspective view of a segment of FIG. 12.
Figure 14:
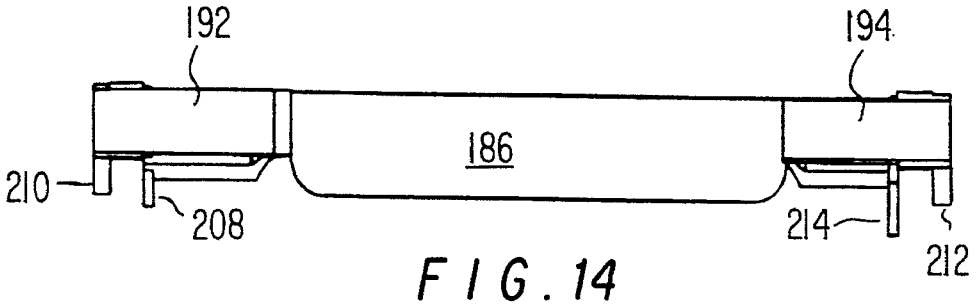
FIG. 14 shows a top plan view of a segment of FIG. 12 in the direction of arrow 14.

As is best seen in FIG. 13, a pair of complementally shaped inner and outer semi-circular tabs 208 and 210 extend from the front surface of the segment. A similar pair of complemental tabs 212 and 214 extend from the front face in line with the corresponding semi-circular recesses 202 and 204. A pair of round cylindrical apertures 216 and 218 extend through the side walls 188 and 190 between the previously described indents and tabs for receiving cable ends. The base 186 is formed with a curved convex surface 219 and an overhanging leading edge 220 having a tapered inner surface 221. A pair of raised or stepped portions 222 and 223 which have similarly convex curved rear faces 219A and 220A and corresponding concave front faces 219B and 220B extend from opposite ends of the base 186. The re-entrant portions 192 and 194 are similarly provided with convex rear faces 192A and 194A and concave front faces 192B and 194B.

Referring now to FIGS. 14 to 16B, various other views of the segment illustrated in FIGS. 12 and 13 are shown. In FIGS. 16A and 16B, it can clearly be seen how the rear semi-circular recesses 196, 198, 202 and 204 engage rotably with the corresponding respective semi-circular tabs 210, 208, 212 and 214 of an adjacent segment 184A. The semi-circular recesses have a common transverse axis of rotation 224, and the semicircular tabs have a similar common axis of rotation 226 which is disposed directly in front of the axis 224. The hollow structure of each segment is clear from FIGS. 13 and 15, in which it can be seen how a segment is divided into various compartments 228 by means of dividing walls or webs 230. In FIGS. 15C and 15D, it can clearly be seen how the re-entrant portions 192 and 194, the raised portions 220 and 222 and the central base portion 186 all have hollow C-shaped cross-sectional profiles. As is the case with the H-shaped profile illustrated in FIG. 7A, this facilitates torsional flexure of the various profiles about a major axis 232 of the base section 186. The bending stiffness of the C-shaped section illustrated in FIG. 15D is roughly proportional to $bh^3$–$b*h*^3$, which is not markedly different to a corresponding solid section, which has a bending stiffness proportional to $bh^3$, with an increased bending stiffness of only 20%.

The torsional stiffness of the C-shaped section is proportional to $0.312\ Lt^3$, with L equalling the length of the dashed line, whereas the torsional stiffness of a corresponding solid section is proportional to $0.312\ bh^3$. Using the dimensions of the particular embodiment, this results in a reduction in torsional stiffness of approximately 95%. Consequently, the C-shaped section has the advantage of using less material to achieve a lighter structure with an insignificant reduction in bending stiffness and a desirable marked increase in torsional flexure.

Figure 17:
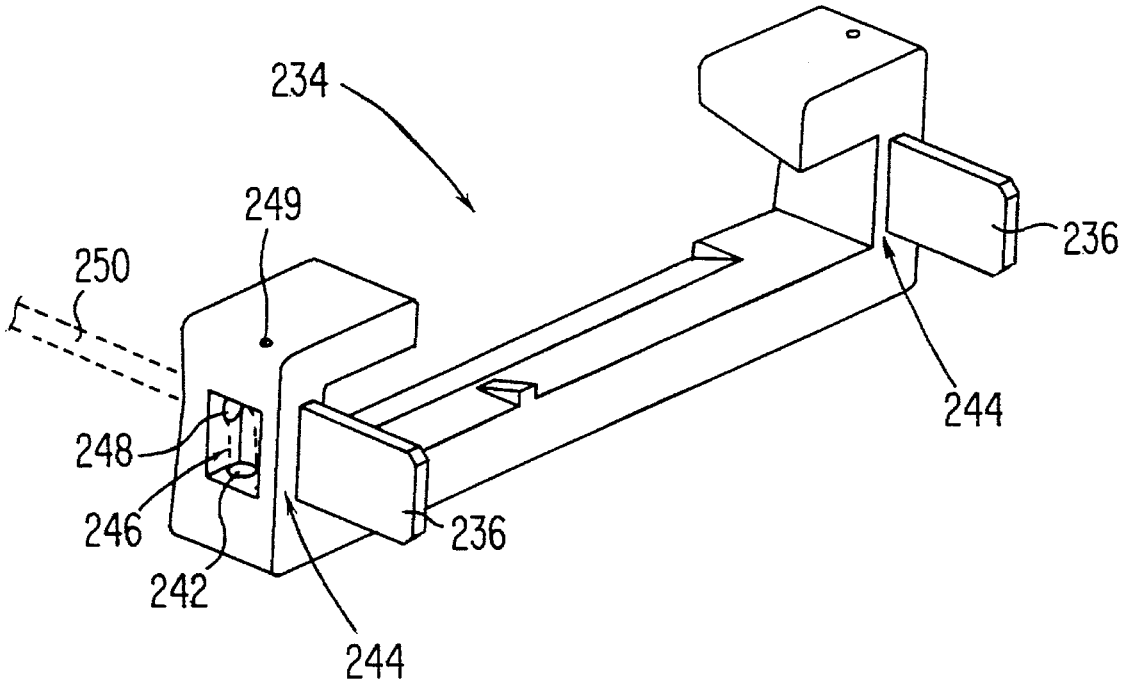
FIG. 17 shows a top perspective view of an end connector piece arranged to be linked to the segment of FIGS. 12 to 16.
Figure 18:
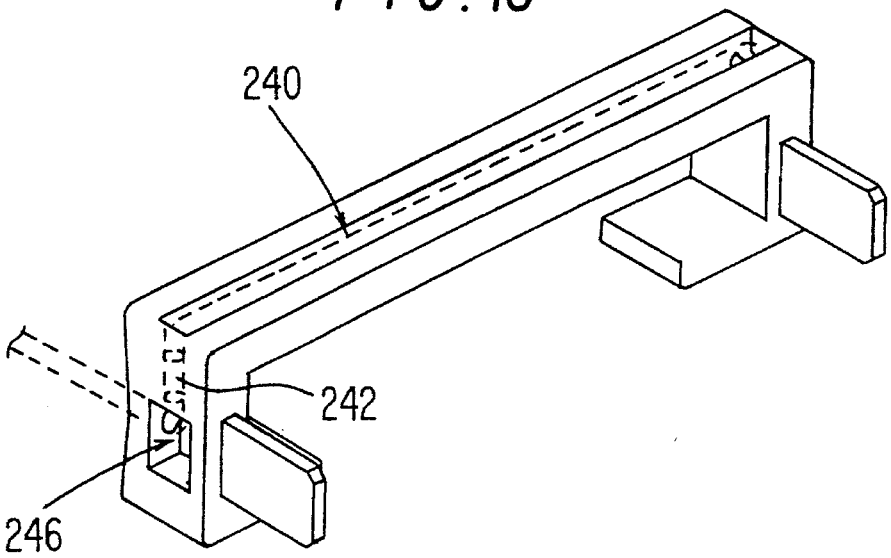
FIG. 18 shows a bottom perspective view of the end connector piece of FIG. 17.
Figure 20:
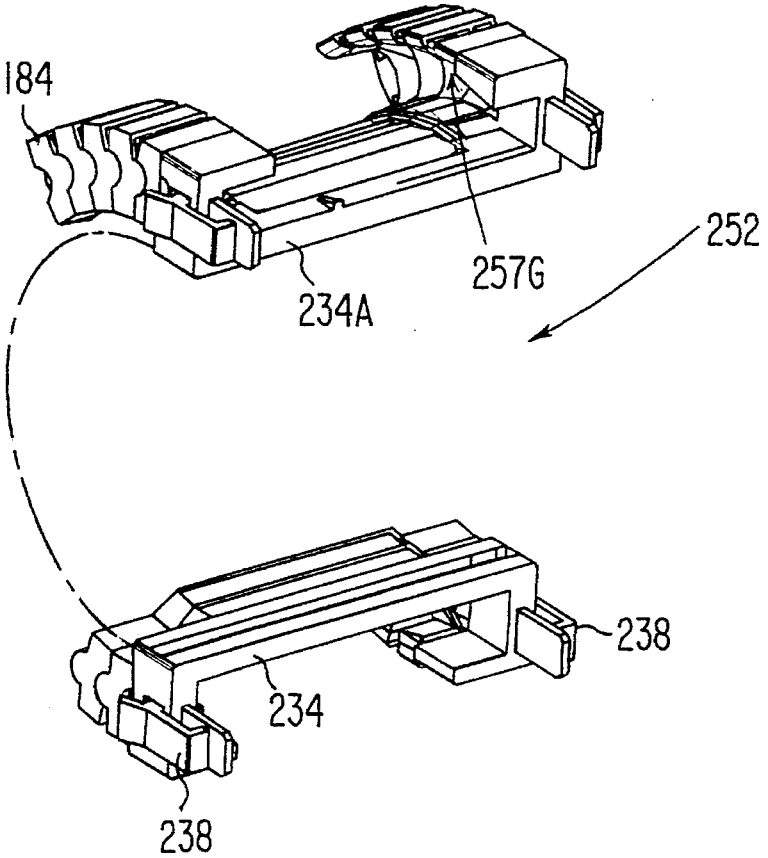
FIG. 20 shows part of the further preferred embodiment of the ammunition feeder chute formed from the segments of FIGS. 12 to 16 and the end connector pieces of FIGS. 17 and 18.

Referring now to FIG. 17, an end connection piece 234 is shown. The end connection piece 234 is formed from an aluminium alloy. Rectangular mounting tabs 236 extend from the front of the end connection piece. The mounting tabs, in conjunction with sprung clips 238 illustrated in FIG. 20, are used to clip one end connection piece to standard connectors on a feeder outlet on an ammunition box and the opposite end connection piece to a standard connector adjacent the breech of an anti-aircraft gun or the like. A channel 240 extends along the underside of the end connection piece, and apertures 242 extend from opposite ends of the channel downwardly through the side walls. The apertures 242 terminate in a recess 246 extending into each side wall 244. A further aperture 248 extends through the side wall towards the rear face of the connection piece 234. Pin apertures 249 are formed through the side walls for accommodating a pivot pin for mounting each sprung clip 238. A cable 250 is threaded through the apertures 248 and 246 and into the channel 240. The cable 250 may be in the form of an ultra-high molecular low stretch polyethylene rope which may have a breaking strain of up to 3.8 tons.

An assembled ammunition feeder chute 252 is shown in FIG. 20. The ammunition feeder chute terminates in the end pieces 234 and 234A, and has a flexible section formed from the inter-engaging segments 184. In assembling the ammunition feeder chute 252, the rope 250 is threaded through the apertures 248 and 242, along the channel 240 and back through similar apertures formed in the side wall 244 of the end connection piece 234. The opposite free ends of the rope are then threaded through the apertures 216 and 218 in a series of adjacent segments 184, the particular application for which the feeder chute is required determining the length of the chute and the resultant number of segments required. The opposite end piece is then threaded onto the free ends of the rope 250, which are fed through the apertures in the side walls 244 of the end connection piece 234A. The rope ends terminate in the channel 240 where they overlap one another. The ends of the rope may then be encased within a sleeve, and the sleeve may in turn be embedded with a resinous compound which is poured into the channel 240 in order to secure the ends firmly in position.

Figure 19:
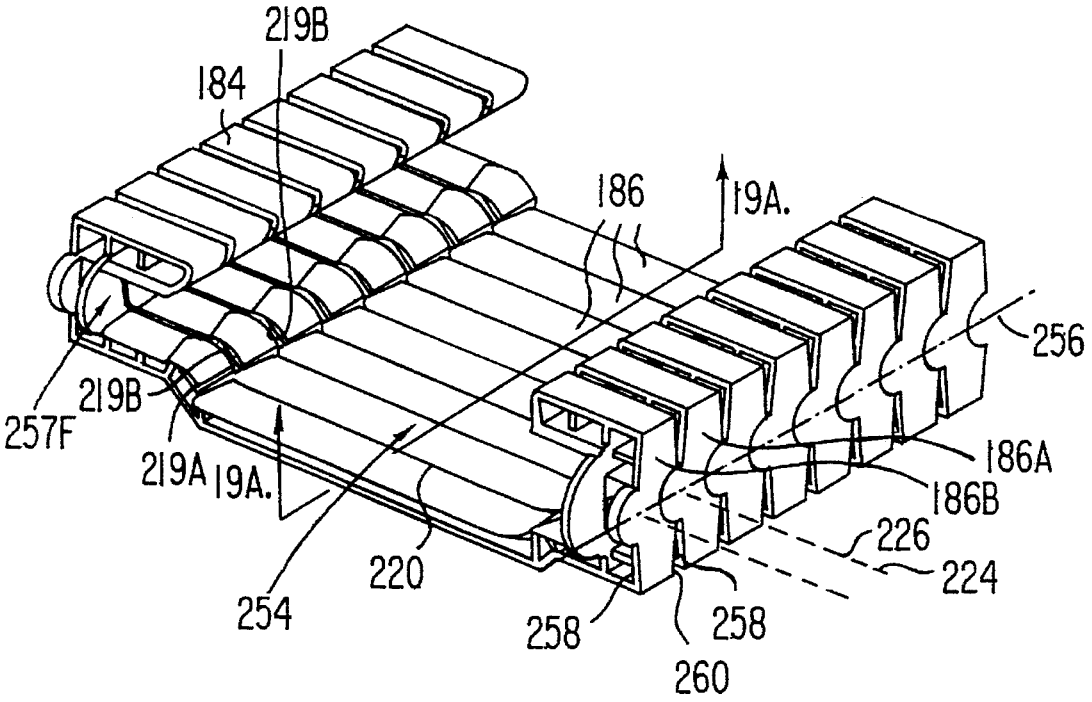
FIG. 19 shows a top perspective view of a plurality of segments of FIGS. 12 to 16 articulated together.
Figure 19A:
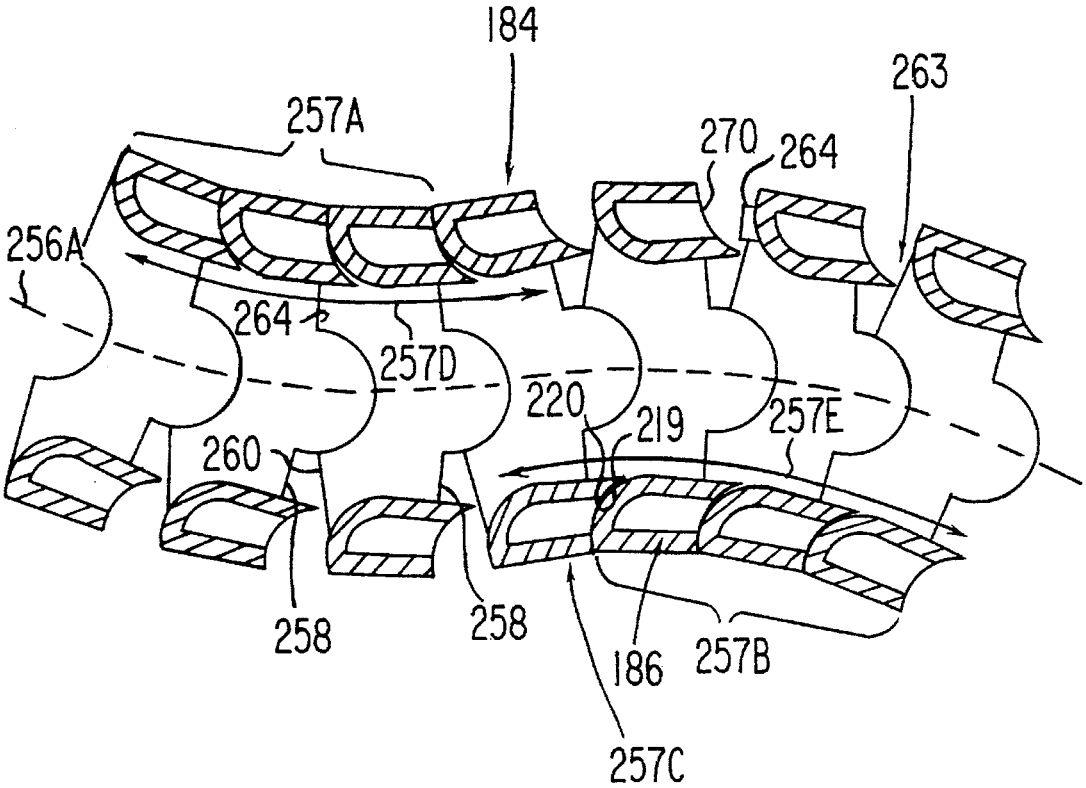
FIG. 19A shows a cross-section similar to that on the line 19A—19A of FIG. 19 with the segments articulated in an S-configuration.

Referring now to FIGS. 19 and 19A, it can clearly be seen how the various segments 184 inter-engage with one another. The front overhanging concave edge 220 of one segment overlaps the rear convex surface 219 of a trailing segment with the result that a smooth continuous surface 254 is defined by the various inter-engaging bases. Similarly, it can clearly be seen in FIG. 19 how the concave front surface of one of the raised portions 219B is arranged to glide smoothly over a corresponding convex rear surface 219A of an adjacent segment. The front axis of rotation 226 of a segment 186A is coincident with a rear axis of rotation of a subsequent segment 186B, with a result that the various segments are able to pivot freely relative to one another about their common axes of rotation. It is also clear from FIG. 19 how the various axes of rotation lie along a common line of flexure 256. In FIG. 19A, the line of flexure takes on an S-shaped configuration, as is shown at 256A, which shows a cross-section of part of a belt with the first three inverted segments 257A bent into a concave configuration and the last three upright segments bent into a convex configuration 257B with an intermediate interconnecting segment 257C. Continuous contact zones or lands 257D and 257E are provided for an ammunition belt, by the contiguous overlapping bases of the segments. Likewise, the inner tabs 208 and 214 and recesses 198 and 204 on each segment define continuous lapped side wall surfaces 257F and 257G. Flexure of the ammunition feeder belt is limited by the inwardly tapering front and rear surfaces 258 and 260 of each segment. This is best seen in FIG. 19A at 262, where the front and rear surfaces are contiguous with maximum convex flexure of the belt, and where the surfaces are separate at 263, with maximum concave flexure of the belt.

Figure 21:
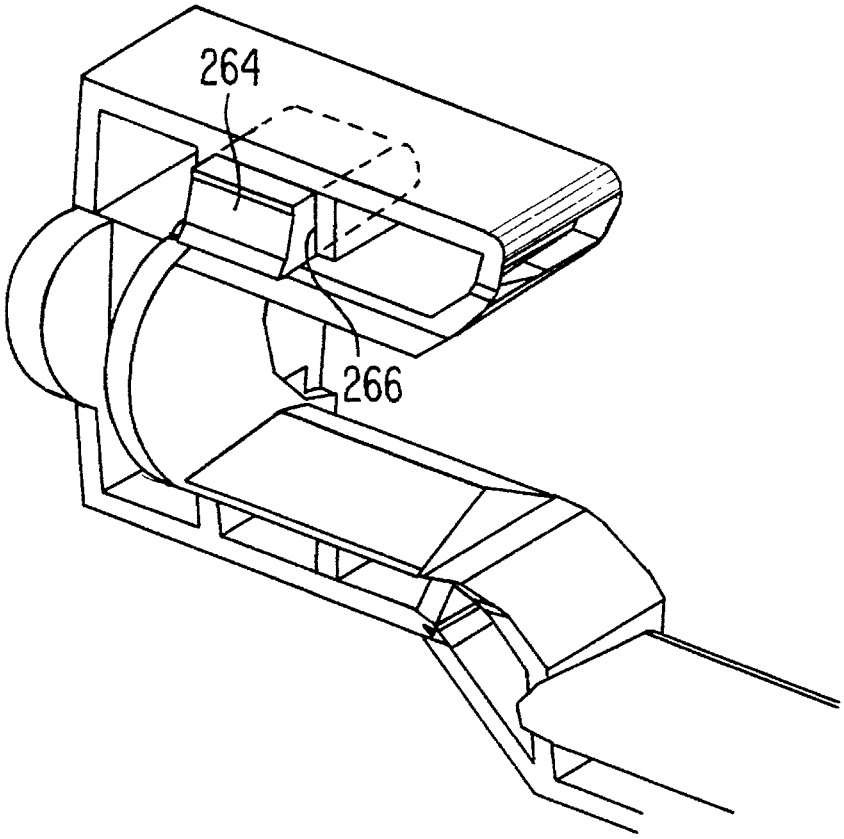
FIG. 21 shows a close-up perspective view of a segment of FIGS. 12 to 16 fitted with a spacing insert.

Referring now to FIG. 21,, the overall degree of flexure of the belt may be controlled by way of inserting inserts 264 into an appropriate cavity 266 formed within the re-entrant portion 192. A similar insert may be inserted into an appropriate cavity 268 in the opposite re-entrant portion 194. The spacing inserts abut against a rear tapered face 270 of an adjacent segment, as can be seen in FIG. 19A, thereby serving to reduce the degree of flexure of the two segments relative to one another. The degree of flexure of an ammunition feeder belt in a particular application may thus be controlled precisely to ensure that it does not buckle or twist unnecessarily in such an application.

Figure 22:
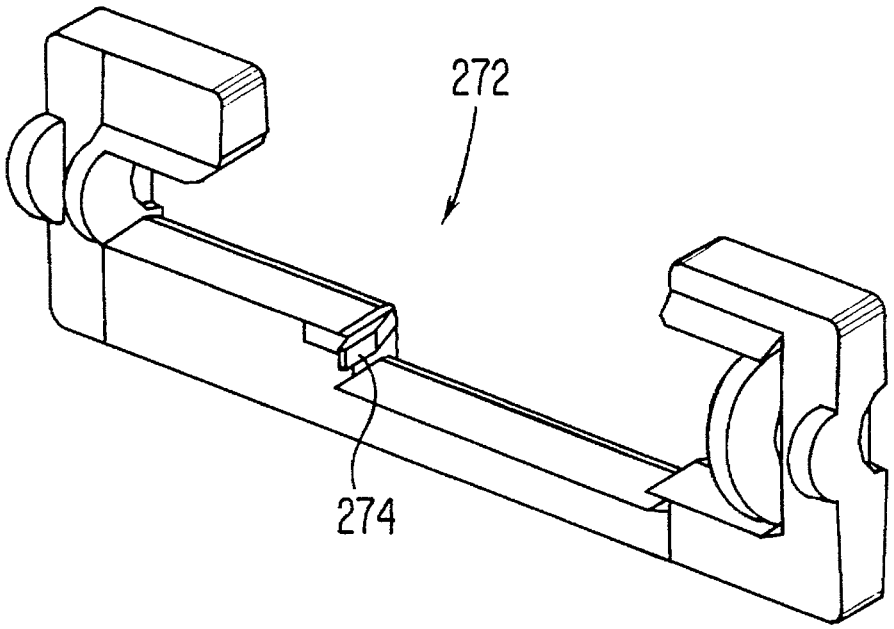
FIG. 22 shows a perspective view of a segment forming part of a still further embodiment of an ammunition feeder chute of the invention.

Turning now to FIG. 22, an alternative embodiment of a segment 272 is shown incorporating a ramp insert 274 which is used to ensure that drag links incorporated on certain types of ammunition feeder clips do not snag or catch on the belt. The insert 274 may be formed from a metal such as an aluminium alloy for providing wear resistance cover extended use of the belt.

Obviously, numerous modification and variations of the present invention are possible in light of the above teachings. It is therefore to be understood that within the scope of the appended claims, the invention may be practiced otherwise than as specifically described herein.

I claim:

1. An ammunition feeder chute, comprising:

a plurality of elongate segments disposed transversely relative to a longitudinal axis of flexure of the chute wherein at least two apertures extend through each segment;

at least one flexible cable which passes through the respective apertures and interconnects the segments in articulated, side-by-side relationship, and a plurality of spacer elements which space the segments apart and allow pivoting of adjacent segments relative to one another, thereby to facilitate flexure of the feeder chute along the longitudinal axis, each segment having a leading face and an opposed trailing face, the leading face of each segment defining an arcuate concave surface and the trailing face of each segment defining an arcuate convex surface, such that the leading face of one segment is arranged to slide over the trailing face of an adjacent segment in an overlapping relationship, thereby to provide a continuous land for an ammunition belt

2. An ammunition feeder chute according to claim 1 wherein each segment is substantially C-shaped in transverse cross section, so as to facilitate torsional flexure of each segment, and to enhance sliding articulation of adjacent segments over one another.

3. An ammunition feeder chute, comprising:

a plurality of elongate segments disposed transversely relative to a longitudinal axis of flexure of the chute, each segment including an elongate base member and a pair of side walls projecting from opposite ends of the base member so as to define a complemental channel for an ammunition belt wherein at least one aperture extends parallel to the longitudinal axis through each side wall;

at least one flexible cable passing through the aperture and interconnecting the segments in an articulated, side-by-side relationship; and a plurality of spacer elements extending from the side walls alongside each aperture, the spacer elements defining transverse axes of rotation perpendicular to the longitudinal axis, about which adjacent segments are arranged to pivot so as to facilitate flexure of the feeder chute along the longitudinal axis wherein the spacer elements comprise a pair of arcuate tab formations extending from a leading face of each side wall, and a complemental pair of recess formations formed in a trailing face of each side wall, with the aperture extending from the leading to the trailing face between the pair of tab formations and the pair of recess formations.

4. An ammunition feeder chute according to claim 3 in which the pair of tab formations comprises an inner tab and an outer tab, and the pair of recess formations comprises an inner recess and an outer recess, with the inner tab and the inner recess in combination defining a continuous uniplanar inner surface of the side wall when the segments are assembled together and the outer tab and outer recess in combination defining a continuous uniplanar outer surface of the side wall.

5. An ammunition feeder chute according to claim 3 in which the aperture is located midway between the pair of tab formations and the pair of recess formations and the pairs of tab and recess formations are located midway along the side walls between upper and lower ends thereof.

* * * * *